United States Patent [19]

Marschke

[11] Patent Number: 4,985,012

[45] Date of Patent: Jan. 15, 1991

[54] APPARATUS FOR STRIPPING SCRAP FROM DIE CUT BLANKS

[75] Inventor: Carl R. Marschke, Phillips, Wis.

[73] Assignee: Marquip Inc., Phillips, Wis.

[21] Appl. No.: 409,112

[22] Filed: Sep. 19, 1989

[51] Int. Cl.[5] ..... B31B 1/74; B26F 1/00

[52] U.S. Cl. ..... 493/373; 493/472; 83/102; 83/161

[58] Field of Search ..... 493/82, 83, 342, 373, 493/472; 83/102, 106, 107, 156, 161

[56] References Cited

U.S. PATENT DOCUMENTS

| | | | |
|---|---|---|---|
| 2,647,446 | 8/1953 | Kane | 493/342 |
| 2,759,402 | 8/1956 | Jedlick | 493/342 |
| 2,779,257 | 1/1957 | Jedlick | 493/342 |
| 2,935,916 | 5/1960 | Walker | 493/373 |
| 3,320,864 | 5/1967 | Zernov | 493/373 |
| 3,459,080 | 8/1969 | Goettsch | 493/342 |
| 3,524,364 | 9/1970 | Bishop | 493/342 |
| 3,643,553 | 2/1972 | Morimoto | 493/373 |
| 3,949,653 | 4/1976 | Schroter | 493/373 |
| 3,956,974 | 5/1976 | Schroter | 493/342 |
| 4,031,816 | 6/1977 | Matsuo | 493/373 |
| 4,100,844 | 7/1978 | Spengler | 493/472 |
| 4,295,842 | 10/1981 | Bell | 493/342 |
| 4,367,069 | 1/1983 | Bishop | 493/342 |
| 4,474,565 | 10/1984 | Watson et al. | 493/342 |
| 4,561,334 | 12/1985 | Sarka | 493/342 |

*Primary Examiner*—William E. Terrell

*Attorney, Agent, or Firm*—Andrus, Sceales, Starke & Sawall

[57] ABSTRACT

An apparatus for stripping the scrap portion from a die cut blank includes a stripper pin carrier providing a pattern of stripper pins supported in a resilient compressible material layer in which the stripper pins are demountably embedded. The stripper pins may be inserted into the resilient layer to provide a pattern or patterns which will accommodate virtually any size, shape and location of scrap portions to be stripped from a blank. The stripper pins can be removed and reinserted in a different pattern to accommodate a different run of blanks of corrugated paperboard or the like. Programmable robotic control may be used for pin placement and removal. A unique positive stripping apparatus includes a resilient soft-covered roll beneath the blank at the point of stripping and into which the leading edge of the scrap portion is pressed by the stripper pins on the upper rotary pin-carrying roll. The stripping pins initially displace the leading edge of the scrap portion from the plane of the blank and into the soft layer of the roll until the edge is captured by the stripping edge of a downstream scrap carrier. The scrap carrier traps the scrap portion against the soft deformable layer of the lower roll and continued rotation of the roll effects a positive stripping of the scrap from the blank and carries the scrap away for disposal.

35 Claims, 3 Drawing Sheets

FIG. 1
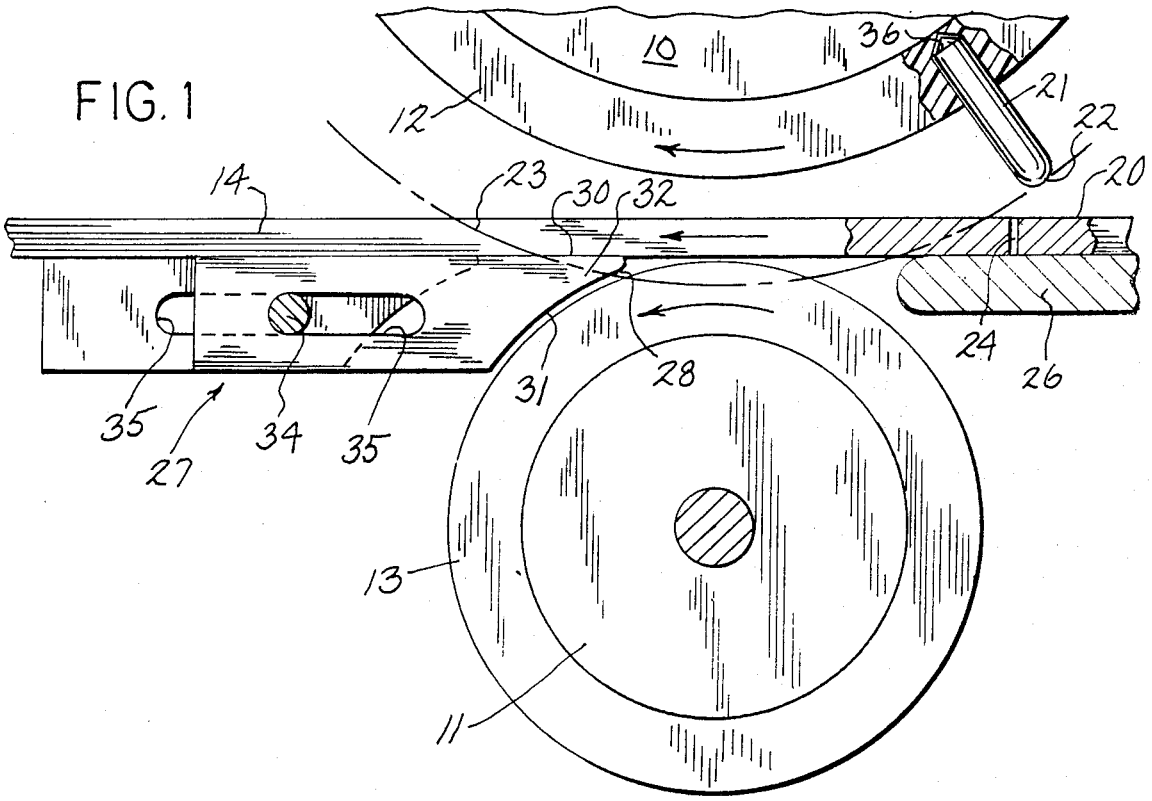
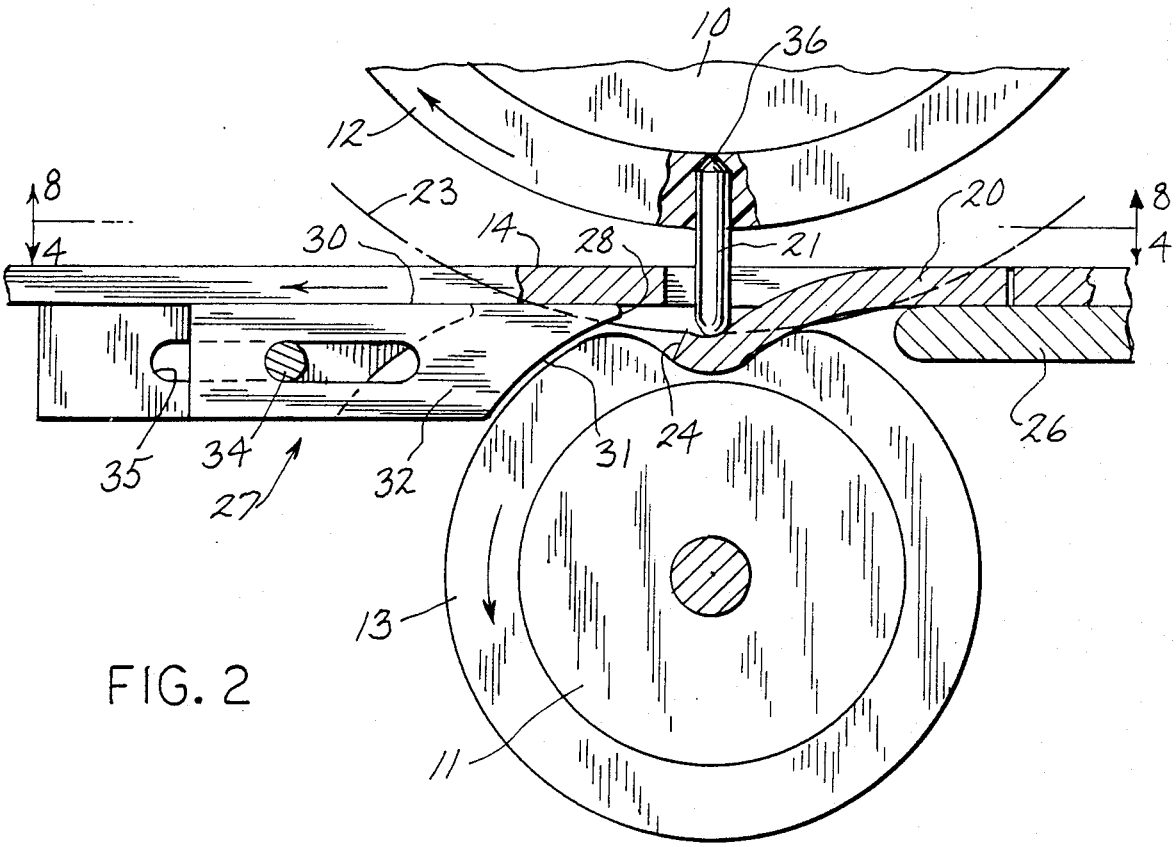
FIG. 2

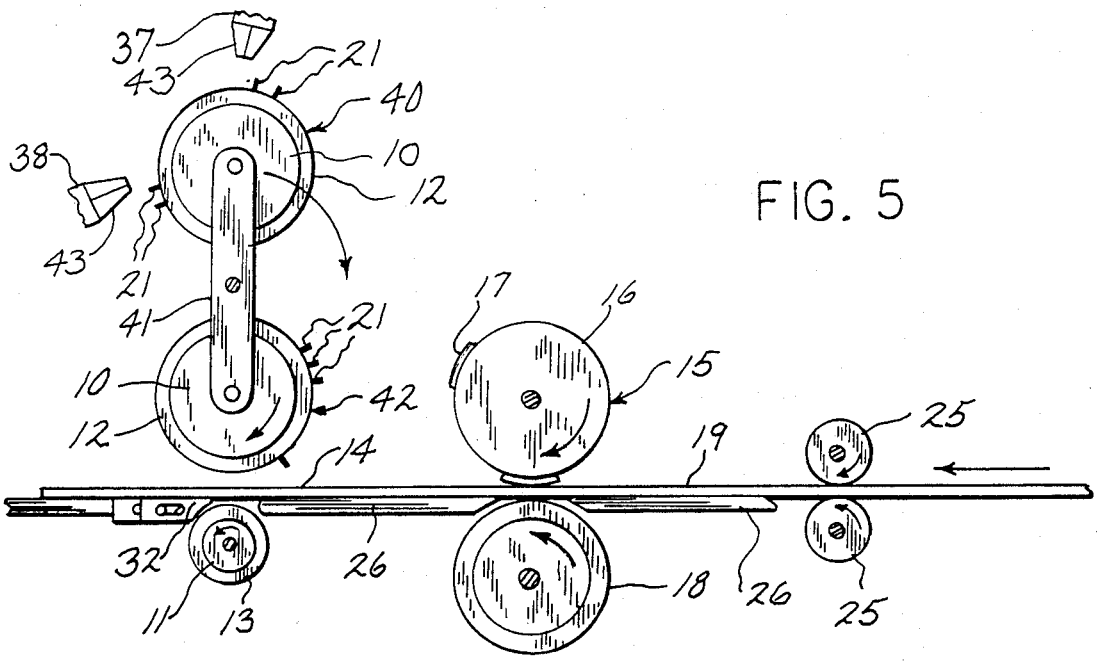
FIG. 5
FIG. 6
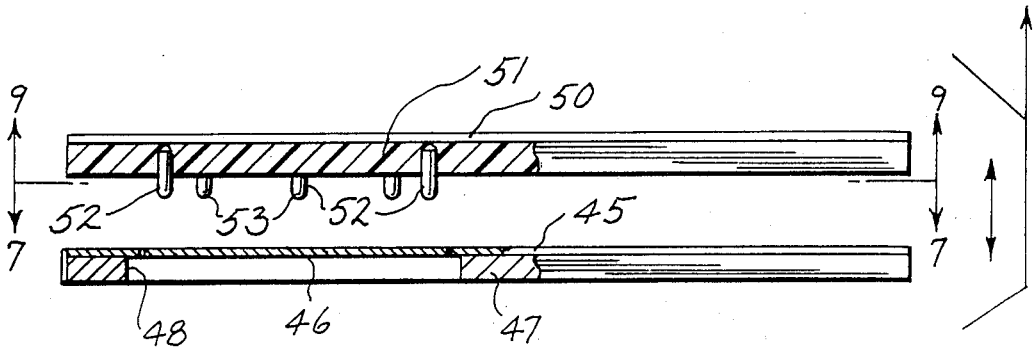
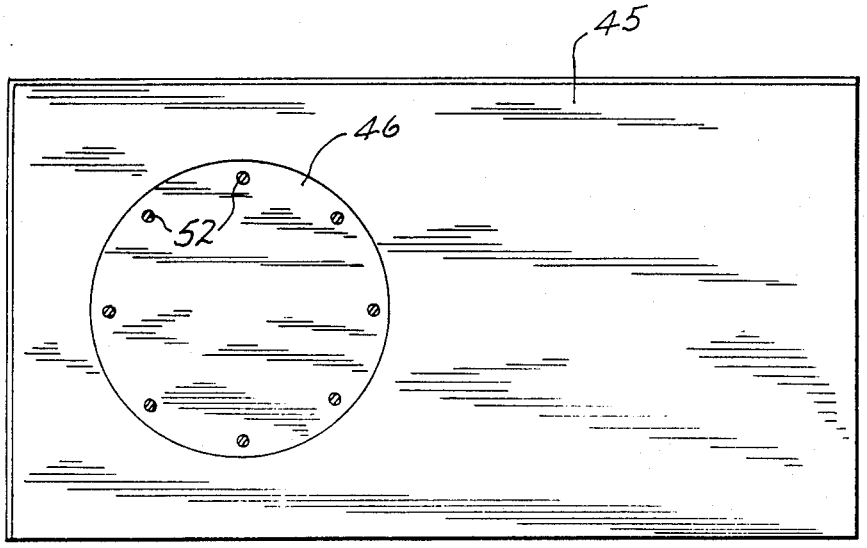
FIG. 7

APPARATUS FOR STRIPPING SCRAP FROM DIE CUT BLANKS

BACKGROUND OF THE INVENTION

The present invention pertains to the manufacture of blanks of corrugated paperboard, solid fiberboard and similar materials and, more particularly, to an apparatus for stripping the scrap portions from die cut blanks used in the manufacture of boxes, cartons and the like.

Blanks of various sizes and shapes, from which boxes, cartons and similar structures are ultimately formed, are die cut from sheets of corrugated paperboard, solid fiberboard or other paper materials. In the die cutting operation, various portions on the interior of the die cut blank may also be cut to different sizes and shapes to provide openings, slots or the like required to enable the blank to be subsequently folded to form a box or similar structure. The die cut interior portions result in scrap which must be removed from the blank in a stripping operation. The manner in which the scrap is stripped from the blank generally depends upon the die cutting method used.

Die cutting may be done by either the flatbed method or the rotary method. A flatbed die cutter utilizes a cutting tool which makes a linear stroke in one position against a flat backing plate or anvil. In a rotary die cutter, the cutting die or dies are mounted to the periphery of a cylindrical roll and the sheet from which the blank is cut is fed between the die roll and a counterrotating backing or anvil roll. In either process, the scrap portions are retained in the blank after cutting and must be mechanically stripped therefrom.

The stripping process in a flatbed die cutting operation usually comprises advancing the die cut blank horizontally to a stripping position in which the scrap portion or portions overlie a stripping die with openings corresponding to the shape of the scrap (but slightly larger) and the remainder of the stripping die supporting the finished blank. A stripper is positioned above the scrap and die to make a linear downward stroke against the scrap and push it through the die and out of the blank. In one known flatbed stripper construction, the stripper plate includes a gridwork pattern on its underside in which downwardly extending stripper pins can be positioned by hand to define generally the outline of the scrap portion to be removed. When the stripper is stroked downwardly against the scrap, the pins engage the peripheral edge of the scrap portion and push it through the stripper die.

In a rotary die cutting process, the stripping process is also typically a rotary process. Thus, the die cut blank with the scrap portions intact is advanced past a rotary stripper roll which has a series of stripper pins attached to its cylindrical exterior, which pins are positioned to correspond to the outline of the scrap portion or portions and rotation of the stripper role is synchronized with the die cutting roll such that the stripper pins accurately engage and punch out the scrap from the blank as the blank is advanced from the die cutting station to the stripping station.

In the case of a flatbed die cutter, the stripper pins are typically positioned by hand to correspond to the shape of the scrap portion and the process is tedious and time consuming. These problems are aggravated where successive runs of blanks of different sizes and shapes are made, requiring frequent repositioning of the stripper pins.

In rotary strippers, a cylindrical metal sleeve is mounted to the outside of the stripper roll and a pattern or patterns of pins corresponding to the outlines of the scrap portion or portions are fixed to the surface of the metal sleeve. Each time a run of different blanks is made, the stripper pin sleeve must be removed from the roll and replaced with one accommodating the different scrap patterns of the new run. In a large volume operation the large number of stripper pin sleeves results in the need for a huge storage area and concomitant storage problems.

U.S. Pat. No. 3,524,364 discloses a rotary stripper apparatus in which the stripper pins force the scrap material portions into the surface of a soft covered counterrotating roll disposed on the opposite side of the blank. This apparatus provides positive stripping of the scrap, but requires an array of stripper pins corresponding to the outside shape of each scrap portion. Also, the pins are mounted on the cylindrical metal sleeve typical of prior art constructions.

U.S. Pat. No. 4,367,069 discloses a rotary stripping apparatus in which one of a pair of counter-rotating rolls has a series of extensible and retractable spikes having barbed ends which impale the scrap portion in cooperation with extensible and retractable abutments located on the other roll. Extension and retraction is provided by a suitable camming apparatus, all of which results in a mechanical apparatus which is rather complex and far too costly for use in small or one-time runs of die cut blanks.

U.S. Pat. No. 4,295,842 also utilizes a rotary stripper with pins having pointed outer ends to pierce and carry the scrap portions from the die cut blank. The scrap carried on the pins is subsequently stripped by carrying it past a stripper plate which causes the scrap to be pulled from the pins as the stripper roll rotates past it. Neither positive stripping of the scrap from the blank nor of the scrap from the pins is assured. Similarly, U.S. Pat. No. 2,647,446 utilizes stripper pins on a rotary drum which impale and carry the scrap portion from the blank to a rotationally displaced region where the scrap is stripped from the pins.

U.S. Pat. Nos. 4,474,565 and 4,561,334 disclose rotary die cutting apparatus in which the stripper mechanism is integral with the cutting die. Both utilize radially extensible stripper pins inside the cutting die which move outwardly and engage the scrap portions to eject them from the die cut blank. In the former patent, the ejector pins push the scrap from the blank and, in the latter, the pins penetrate the scrap portions which are then rotated out of the plane of the blank for mechanical stripping from the pins by a stripper blade adjacent the surface of the pin-carrying roll.

U.S. Pat. No. 3,956,974 similarly discloses a rotary stripping mechanism utilizing stripper pins which are axially extensible and retractable. The stripper pins, which are spring biased outwardly, are adapted to engage the scrap material, hold it against the surface of an opposing counterrotating roll, and force the scrap out of the plane of the blank as the pin and the adjacent surface of the roll rotate away from one another. The stripper pins are adjustable circumferentially to selectively variable positions and the mounting ring holding the pins is adjustable axially along the roll-supporting shaft to provide adjustable lateral positioning of the pins. This apparatus relies entirely on the stripper pins to completely strip the scrap portions from the blank.

U.S. Pat. No. 3,459,080 shows a rotary stripping apparatus in which the stripper pins are selectively embedded in a rigid semi cylindrical stripping die demountably attached to the surface of a stripper roll. The stripper pin pattern corresponds to the outline of the scrap portions to be stripped. The pins engage and push the scrap portions downwardly out of the advancing blank and the downwardly displaced scrap portions are caught under the edge of a stripper blade to positively ensure stripping of the scrap from the blank.

SUMMARY OF THE INVENTION

In accordance with the present invention, both of a pair of counterrotating rolls have a layer of a resilient compressible or deformable material attached to the outer cylindrical surfaces thereof. The roll surfaces are spaced apart and appropriate means are provided for advancing a previously die cut sheet between the rolls. A plurality of stripper pins are embedded in the material layer of one of the rolls and extend radially outwardly from the roll to engage the leading edge of the scrap portion of the die cut sheet and press it into the material layer of the other roll to displace the edge of the scrap out of the plane of the die cut sheet. A scrap carrier which is disposed under the advancing sheet and adjacent the downstream surface of the other roll includes a stripping edge which is adapted to capture the displaced scrap edge and hold the scrap against the resilient material layer on the other roll to positively complete the stripping of the scrap portion from the sheet.

The resilient layer on the pin-carrying roll comprises a rubber-like material into which pointed stripper pins are individually inserted in a patterned array which is representative of the location of each leading edge of a scrap portion in the die cut sheet. The outer ends of the pins may be relatively blunt to facilitate engagement of the scrap portions and pressing them into the soft material layer of the other roll.

Means for automatically inserting the stripper pins into the material layer comprises a programmable robotic apparatus. Similarly, the stripper pins may be automatically removed from the stripper roll by a similar or the same robot. In this manner, the stripper roll may be used over and over with "programmed" pin placement to accommodate any scrap pattern presented by a run of die cut sheets. The problem of stripper pin cylinder storage is completely eliminated. In addition, the apparatus may include a system for preparing a subsequent stripper roll in advance of its use and while a previously prepared stripper roll is in active use. Thus, a pair of stripper pin-carrying rolls is rotatably mounted to the end of a rotating carrying arm for movement between operative and preparatory positions. The active stripper roll is disposed in the operative stripping position, while the inactive roll is disposed in the preparatory position in operative relation to the programmable robotic apparatus. When a run of die cut sheets is finished, the active roll is rotated to the preparatory position for pin removal and automatic insertion of the new pin pattern, while the previously prepared roll is rotated into an active position for stripping scrap from the next run of different die cut sheets. In the preparatory position, the apparatus for inserting and removing the pins preferably includes means for rotationally indexing the roll and for indexing the robotic pin placer axially along the surface of the roll to establish the positions of the pins in the patterned pin array.

The robotic pin placing apparatus may utilize a conventional robotic hand to which the stripper pins are fed in a linear series for individual insertion into the rubber layer. The sharp, pentrating ends of the pins may be provided with threads, flutes or the like to enhance their grip in the rubber matrix. In addition, the robotic hand may be adapted to twist the stripper pins slightly upon insertion to enhance alignment as well as holding force of the pin in the layer.

The scrap carrier adjacent the surface of the other roll includes a flat horizontal upper surface for carrying the stripped die cut sheet, which surface also defines the stripping edge. Preferably, the stripping edge comprises a comb-like structure including a series of teeth which are selectively retractable from the edge to form open spaces between alternate teeth which spaces are positioned to allow passage of the stripper pins therethrough and between the teeth as the pins rotate out of engagement with the scrap portions and the resilient surface on the other roll. The teeth may be made to be automatically retractable to define spaces corresponding to the programmed pin placement, utilizing the same programmable controller. The scrap carrier includes a semi cylindrical lower surface extending from the stripper edge and disposed concentrically with and spaced from the surface of the other roll. Spacing between the semicylindrical surface of the scrap carrier and the resilient layer on the other roll is less than the thickness of the scrap layer stripped from the sheet. In this manner, the scrap portions will be engaged between the two surfaces and, due to the higher coefficient of friction of the material comprising the resilient compressible layer, the scrap will rotate with the roll to complete the stripping, as necessary, and convey the scrap portion to an appropriate rotationally displaced discharge area. The resilient compressible layer on this roll is preferably a relatively soft foam material.

Both natural and synthetic rubber compounds may be used for the material layers. The material layer on the pin-carrying roll may comprise a plurality of layers of materials having varying compressibility or durometer. In one embodiment, compressibility of the layers decreases in a radially outward direction, such that the stiffer outer layer or layers provide better support against possible pin deflection. In a preferred embodiment, a relatively softer intermediate layer may be sandwiched between two thinner and relatively harder layers. The harder inner and outer layers hold the pins in position and the softer intermediate layer provides additional support.

The resilient pin-carrying material layer on the stripper roll of the rotary embodiment may also be applied to a flatbed die cutting apparatus. Thus, a planar material layer may be utilized to provide a stripper pin supporting matrix that is vertically reciprocable with respect to a lower aligned stripper die positioned to support the die cut sheet around the opening defining the scrap portion. The stripper pin matrix is caused to move linearly downwardly into engagement with the scrap portion and push it through the stripper die and strip it from the die cut sheet. The stripper pins may also be inserted into the planar supporting matrix by a robot operated with a programmed controller. In this manner, the stripper pin supporting matrix can be prepared automatically in advance of its need and reused many times with different stripper pin patterns by automatic pin removal and replacement.

BRIEF DESCRIPTION OF THE DRAWINGS

FIG. 1 is a sectional side elevation of the rotary stripping apparatus of the present invention showing the relative positions of the rotating rolls and stripper pin with respect to the scrap portion of a die cut blank just prior to stripper pin engagement of the scrap portion.

FIG. 2 is a view similar to FIG. 1 showing initial engagement of the stripper pin with the scrap portion to displace it out of the plane of the die cut blank.

FIG. 5 is a generally schematic side elevation of a rotary die cutter and stripper apparatus of the present invention, additionally showing the programmable robotic pin insertion and removal mechanism.

FIG. 6 is a sectional side elevation of a stripper apparatus for a flatbed die cutter utilizing the present invention.

FIG. 7 is a top plan view partly in section taken on line 7—7 of FIG. 6.

DETAILED DESCRIPTION OF THE PREFERRED EMBODIMENTS

Figure 3:
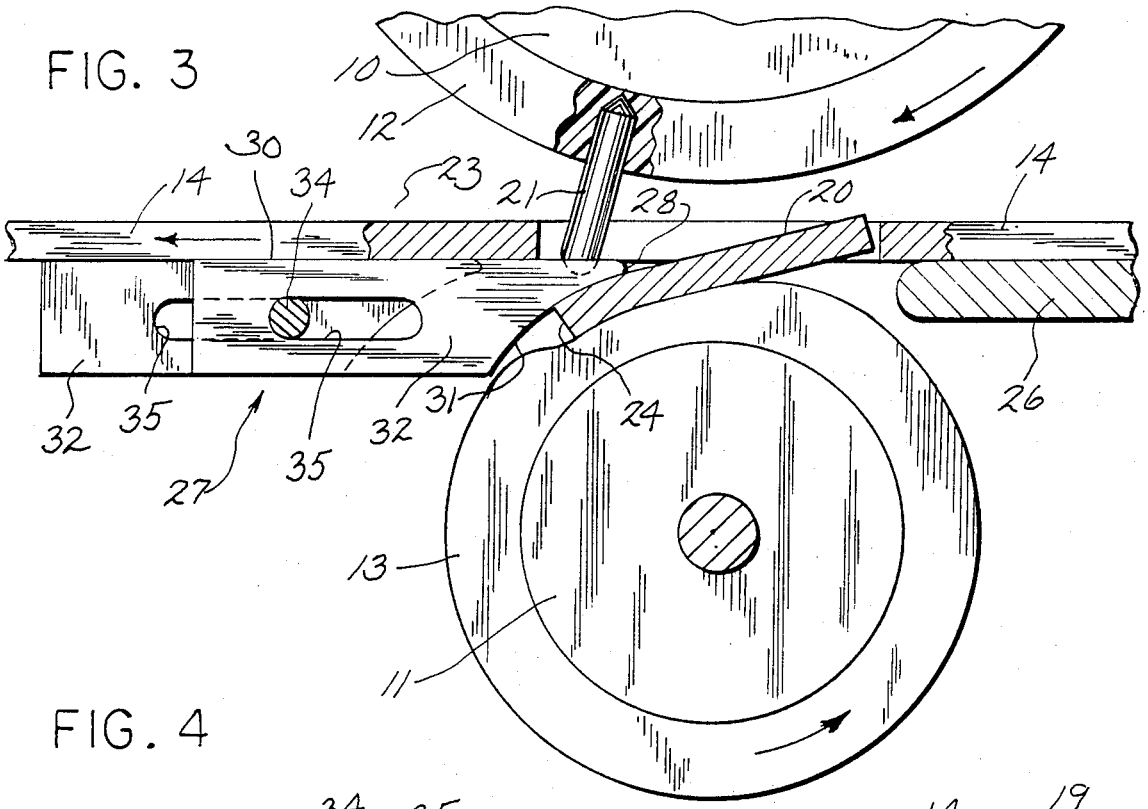
FIG. 3 is a view similar to FIGS. 1 and 2 showing engagement between the scrap portion and the scrap carrier at the approximate point of stripper pin disengagement from the scrap portion.

The rotary stripping apparatus of the present invention includes a pair of counterrotating rolls, comprising an upper stripper pin-carrying roll 10 and a lower stripper roll 11 carried in a suitable supporting framework (not shown). Each of the rolls 10 and 11 is covered with a layer of a resilient compressible or deformable material including a pin carrying layer 12 on the upper roll 10 and a compressible layer 13 on the lower stripper roll 11. The diameter of the upper pin-carrying roll 10 and its resilient layer 12 is preferably substantially larger than the diameter of the lower roll 11 and its compressible layer 13. However, for reasons which will become apparent from the description which follows, the properties of the layers 12 and 13 are substantially different.

The outer surfaces of the resilient compressible layers 12 and 13 are spaced apart and a die cut blank 14, comprising for example a sheet 19 of corrugated paperboard, is advanced between the rolls from an upstream rotary die cutter 15 (see FIG. 5). The rotary die cutter 15 includes an upper rotary die 16 including one or more cutters 17 adapted to engage the advancing blank 14 and press it against a lower rotary anvil 18 to provide cutout areas to create the pattern in the blank necessary for the subsequent formation of a box, carton or the like. The scrap portions 20 defined by the die cutters 17 remain in place in the blank 14, though severed therefrom, and must be mechanically removed in the downstream rotary stripper.

The upper stripping roll 10 has a series of stripper pins 21 embedded in the resilient layer 12 of a rubber or rubber-like material. Each of the pins 21 has a length greater than the thickness of the resilient layer 12 such that the outer pin end 22 extends radially outward from the outer surface of the roll 10. The position of the outer ends 22 of the pins is such that they subtend and arc or define a cylindrical surface which overlaps and intersects the outer surface of the deformable layer 13 on the lower stripper roll 11, as indicated by the dashed line 23 in FIG. 1.

The rotary stripper rolls 10 and 11 and the position of the stripper pins 21 on the upper roll 10 are synchronized or in register with the rotary die cutter 15 such that a stripper pin 21 or group of such pins will engage the leading edge 24 of a scrap portion 20 as it enters the space between the upper and lower stripper rolls 10 and 11.

The sheet 19 from which the blank 14 and integral scrap portions 20 are formed is advanced horizontally through the system, as by a pair of counterrotating drive rolls 25 engaging the upper and lower surfaces of the sheet. The drive rolls may be located downstream of the stripper mechanism or, alternately, the rotary die cutter 15 and stripper rolls 10 and 11 may be utilized to move the sheet through the apparatus. The sheet 19 is supported for passage through the apparatus by a supporting deck 26 which includes appropriate openings for the rotary die 16 and anvil 18 as well as the upper and lower stripper rolls 10 and 11. The deck 26 is suitably attached to the main supporting framework for the apparatus.

As the die cut blank 14 moves over the supporting deck 26 between the rotary die cutter 15 and the stripper rolls 10 and 11, the stripper pin 21 or an appropriate array of such pins which are embedded in the resilient layer 12 in the upper stripper roll 10 rotate downwardly and in the direction of movement of the blank, as shown in FIG. 1. Continued forward movement of the blank 14 and the associated pin or pins 21 results in engagement of the relatively blunt outer ends 22 of the pins and the leading edge 24 of the scrap portion 20, the removal of which from the blank is desired. Because of the overlap between the circular outer diameter 23 defined by the pin ends 22 and the outer surface of the deformable layer 13 in the lower stripper roll 11, the stripper pin 21 pushes the leading edge 24 of the scrap portion downwardly into the deformable layer 13 and out of the plane of the blank 14, as shown in FIG. 2. Thus, at least the leading edge of the scrap portion 20 is positively stripped from the blank and, momentarily, held firmly against the deformed layer 13 by the stripper pin 21. In this regard, a foam material with fairly high compressibility is most suitable for the layer 13.

Continued rotation of the stripper rolls 10 and 11 and forward movement of the blank 14 causes the leading edge of the scrap portion to be carried toward a scrap carrier 27 which includes an upstream oriented stripping edge 28 lying closely spaced from the surface of the lower stripper roll 11 and parallel to the axis of rotation thereof. The scrap carrier 27 is also attached to the main supporting framework for the apparatus and includes a flat upper supporting surface 30 which lies coplanar with the supporting deck 26. The overlap between the diameter circumscribed by the pin ends 22 and the outer surface of the lower stripper roll 11 is such that the leading edge 24 of the scrap portion 20 is captured under the stripping edge 28 of the scrap carrier 27 while it is still firmly held between the stripper pin (or pins) 21 and the deformable layer 13 on the lower roll 11. The scrap carrier 27 includes a lower semicylindrical surface 31 which extends downwardly and forwardly from the stripping edge 28 and is spaced from the outer surface of the deformable layer 13 on the lower stripper roll 10 by a distance less than the thickness of the sheet 19, including the scrap portion 20. The surface 31 is concentric with the roll 11.

Referring also to FIG. 3, as the stripper pin end 22 continues to rotate along its circular path 23, it moves out of engagement with the scrap portion 20. However, by the time disengagement between the pin 21 and the scrap portion 20 occurs, the scrap portion has been captured between the deformable layer 13 and the semicylindrical surface 31 on the scrap carrier 27. Due to the much greater coefficient of friction between the deformable rubber-like layer 11 and the lower surface of the scrap portion, as compared to the smooth semicylindrical surface 31 and the upper surface of the scrap portion, the scrap portion will be carried by the lower stripper roll 11 downwardly past the semicylindrical surface 3 and positively stripped from the blank 14. The blank, of course, continues its normal horizontal forward movement over the upper supporting surface 30 and out of the stripper. Depending on the thickness of the sheet 19 being processed, the scrap portion will be pressed radially into the compressible layer 13 by varying amounts. A blank pressed into the layer 13 will result in an effective reduction in the radius of the roll 11 and, as a result, a reduction in the angular surface speed of the roll and the scrap portion in contact therewith. Therefore, provision may be made to adjust the rotational speed of the roll 11, so that the angular peripheral speed can be adjusted with variations in sheet thickness to maintain the proper positioning between the blank 14 and the scrap portion 20 stripped therefrom.

In order to provide clearance for the outer ends 22 of the stripper pins 21 as they pass the stripping edge 28 of the scrap carrier 27, the stripping edge comprises a comb-like structure including a series of teeth 32 which are independently movable and selectively retractable from the stripping edge 28 to form open spaces 33 between alternate teeth 32. The teeth 32 are retracted to provide an open space 33 for each stripper pin 21 to allow each pin to pass through the space and between alternate teeth as the pins rotate out of engagement with the scrap portion 20. Those teeth 32, which are fully extended rearwardly in their non-retracted positions, define the stripping edge 28 and provide adequate support for the blank 14 as it passes thereover. As shown in FIGS. 1–4, each of the teeth 32 includes a longitudinal slot 35 by which the teeth are mounted on a common laterally extending support shaft 34. To retract a tooth from the stripping edge 28, it is moved forwardly (in the direction of sheet travel) until the rear edge of the slot 35 engages the support shaft 34. The actual mechanism for retracting the teeth 32 and returning them to the stripping edge 28 may comprise a variety of shuttle or linkage mechanisms which provide either linear reciprocal tooth movement or a combination of linear and rotary movement. In any case, it is preferable to provide means to positively hold the teeth in their rearward positions in the stripping edge to firmly fix the position thereof. As will be described in greater detail hereinafter, retraction or return movement of the teeth may be coordinated with and caused to occur automatically with the establishment of the stripper pin array in the resilient compressible pin carrying layer 12 in the upper stripper roll 10. In addition, tooth movement may be coordinated with rotation of the stripper pin roll 10 to retract a particular tooth only to accommodate passage of a pin and immediately thereafter return the tooth to position in the stripping edge. Maximum continuity in the stripping edge 28 and the semi-cylindrical surface 31 may there be maintained.

Figure 4:
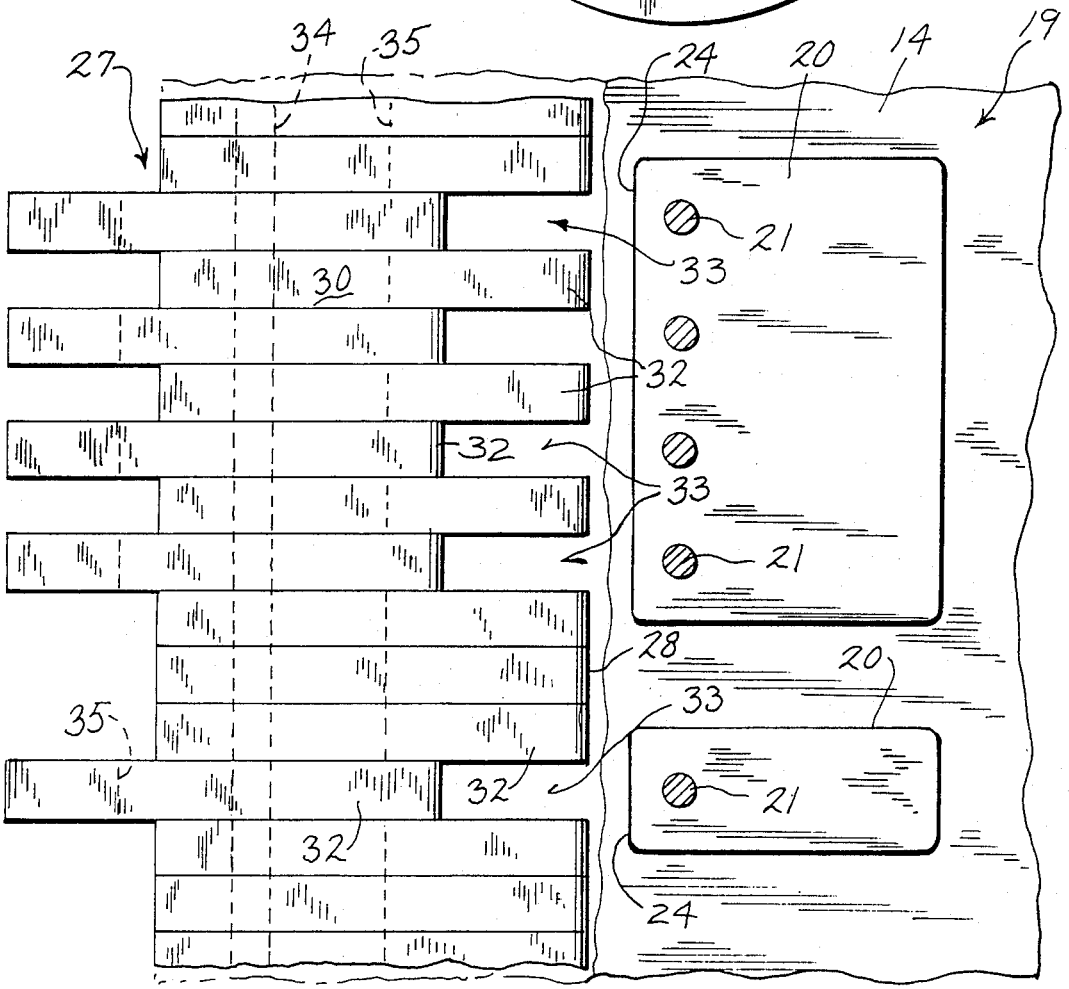
FIG. 4 is a top plan view of the apparatus in the FIG. 2 position.

As may best be seen in FIG. 4, it is normally necessary only to orient the stripper pins 21 in a pattern which causes them to engage the leading edge 24 of the scrap portion or portions 20. As previously indicated, because the pins hold the scrap portion in engagement with the deformable layer 13 on the lower stripper roll 11 until the scrap portion is captured between the surfaces of the lower roll and the scrap carrier 27, any necessary stripping of the remainder of the scrap portion from the blank 14 may be accomplished without the use of additional stripper pins. If the scrap portion 20 has a very narrow lateral dimension (as in the lower portion of FIG. 4), a single stripper pin 21 may be sufficient to effect initial stripping. If the leading edge 24 of the scrap portion 20 has a longer lateral dimension, a series of laterally aligned stripping pins 21 may be required to effect initial stripping.

Referring also to FIG. 5, the stripper pins 21 are adapted to be selectively inserted into and removed from the resilient compressible material layer 12 attached to the upper stripper roll 10. In this manner, the stripper roll 10 can be reused many times with varying stripper pin patterns to accommodate any pattern of scrap portions 20 which must be removed from blanks 14 of widely varying configurations. The stripper pins 21 preferably have relatively sharp inner ends 36 to facilitate penetration into the pin carrying layer 12. The resilient compressible material forming the layer 12 is preferably a fairly firm rubber-like material, including any suitable natural or synthetic rubber, and having a durometer high enough to firmly support the pins. The stripper pins 21 may be driven into the pin-carrying layer 12 by hand or any suitable manner. Preferably, however, the pins are placed automatically by a pin placement robot 37 adapted to insert the pins individually in a preprogrammed manner under the control of a suitable programmable controller of a type well known in the art. Similarly, stripper pins from a prior run of blanks may be removed from the layer 12 by the robot 37, under programmed control, or may be removed by a separate pin removal robot 38 controlled in a similar manner.

Programmed robotic pin placement and removal may be carried out on an inactive stripper roll 40 mounted on one end of a rotatable roll carrying arm 41. At the same time, an active stripper roll 42 is rotatably mounted on the opposite end of the carrying arm 41 in a lower operative stripping position, as previously described. When it is desired to die cut another run of blanks, the active stripper roll 42 is rotated to the upper position and the previously prepared inactive stripper roll 40 is rotated into a lower operative position. While the newly operative stripper roll is operating, the pin removal and placement robots 38 and 37, respectively, may be operated to automatically change the pin pattern in the newly inactive stripper roll.

With the inactive stripper roll 40 in the upper preparatory position, as shown in FIG. 5, the stripper pins 21 may be automatically inserted under programmed control in a patterned array corresponding to the shape and position of the scrap portions 20 to be die cut from the next run of blanks 14. Initially, however, the stripper pins 21 from a prior run of blanks are removed from the inactive roll 40. In either case, the robot may be directed to remove the pins based essentially on the same program previously utilized to insert the pins. Whether operated to insert or remove stripper pins, the robots 37 or 38 are preferably adapted to be indexed laterally along the surface of the inactive roll 40 parallel to its axis of rotation in accordance with a program executed by the programmed controller. Also, the inactive roll 40 is rotatably indexed on its axis to establish the angular position of the pins from some reference point, also under programmed control.

As previously indicated, the programmable controller used to establish the stripper pin pattern in the stripper roll 10 may also be utilized to automatically position the teeth 32 in the scrap carrier 27 to create the spaces 33 necessary to allow passage of the pins. In a somewhat more sophisticated control strategy, the controller may also be utilized to cycle the teeth 32 into and out of the stripping edge 28 in an active manner during rotation of the stripper roll 10 to provide spaces 33 for pin clearance only for that part of the revolution of the roll when the clearance is required. A stripping edge 28 and semicylindrical stripping surface 32 of maximum continuity may therefore be maintained.

Each of the robots 37 and 38 may include a pin gripping and placement device 43 of the type presently used for automatic screw placement, for example. The pin gripping and placement device 43 may incorporate a chuck-like device to which the stripper pins are automatically serially fed in a known manner. The pin gripper 43 may also be adapted to impart an axial twisting movement to the pins as they are inserted to help maintain precise alignment and to secure the pin more firmly in the resilient layer 12. In this regard, the inner ends 36 of the pins may be provided with a threaded, ribbed, or fluted construction to help retain them in place.

The resilient compressible pin carrying layer 12 should be of a fairly stiff natural or synthetic rubber material. The stripper pins 21 must be retained in the layer firmly enough so they are not displaced from their embedded positions which may result in inaccurate stripping and/or inadvertent and potentially damaging contact with the stripping edge 28. In one embodiment, a composite layer 12 may be used including inner and outer layers of a firmer rubber material and an intermediate layer that is relatively softer. In this manner, the inner ends 36 of the pins will be held firmly in the inner layer against axial displacement, the pin bodies will be held in the outer layer against lateral displacement, and the insertion of the pins into the layer will be easier in view of the softer intermediate layer. The resilient deformable layer 13 on the lower roll 11, on the other hand, should be of a much softer and more compressible material. The layer must be readily deformable as a result of the scrap portions 20 being pressed downwardly thereinto by the stripper pins and, for this purpose, a soft foam material layer 11 would be suitable.

Referring to FIGS. 6 and 7, the present invention is shown adapted to use in a flatbed die cutting system. A flatbed die cutter utilizes a cutting die which is reciprocable to make a vertical cutting stroke to form a die cut blank 45 supported on a flat anvil, in a conventional manner not shown. The die cut blank 45 is then advanced to a stripping position shown in FIGS. 6 and 7 where the scrap portion 46 is removed from the blank 45. In the stripping position shown, the blank 45 is supported over a flat stripping die 47 which is provided with an opening 48 just slightly larger than the scrap portion 46 to be stripped. Mounted above the stripping die 47 is a flat metal plate 50 to the underside of which is fixed a layer of a resilient compressible material 51 similar to that previously described with respect to the layer 12 attached to the pin carrying roll 10 of the rotary die cutter embodiment.

A series of stripper pins 52 are embedded in the compressible material layer 51 in the same manner previously described, such that their relatively blunt outer ends 53 project outwardly from the layer 51 and extend vertically downwardly. The stripper pins 52 are disposed in a patterned array which conforms closely to the edge of the scrap portion 46 to be stripped. The stripper pins 52 need only be spaced closely enough to one another to effect complete stripping as the pin-carrying metal plate 50 is stroked downwardly toward the stripping die 47 until the stripper pins engage and knockout the scrap portion 46.

The stripper pins 52 may be automatically inserted into the resilient material layer 51 in a manner similar to that described with respect to the rotary embodiment, such that the stripper plate can be reused many times with the stripper pin pattern varied as needed. Thus, robotic pin placement and removal may be utilized under the control of a programmable controller or the like. In the case of the flatbed die cutter, however, the pin placement robot (not shown) would be programmed to be indexed over the material layer 51 in response to programmed positions in an X-Y pattern. Linear or curved pin patterns, or various combinations thereof, can be easily formed to accommodate the shape of any scrap portion 46. Pin removal may be handled in the same manner previously described, utilizing a pin placement robot or a separate pin removal robot.

Various modes of carrying out the present invention are contemplated as being within the scope of the following claims particularly pointing out and distinctly claiming the subject matter which is regarded as the invention.

I claim:

1. An apparatus for striping the cutout scrap portion from a die cut blank comprising:

lower support means for supporting the blank and providing yieldable support for the scrap portion;

a plurality of stripper pins each including a relatively blunt outer end and a relatively sharp inner end disposed above the blank;

stripper in support means for moving said stripper pins downwardly to bring the blunt outer ends thereof into nonpenetrating surface engagement with the scrap portion and for stripping the scrap from the blank; and, said support means including a stripper pin support matrix comprising a layer of a resilient deformable material into which the inner ends of said stripper pins are demountably inserted.

2. The apparatus as set forth in claim 1 wherein said stripper pins are disposed to engage the preipheral edge of the scrap portion.

3. The apparatus as set forth in claim 2 wherein said stripper pin support matrix is reciprocable vertically with respect to said lower support means and said blank.

4. The apparatus as set forth in claim 3 wherein said material layer is planar and disposed parallel to said lower support means and said blank.

5. The apparatus as set forth in claim 4 wherein said lower support means comprises a stripping die.

6. The apparatus as set forth in claim 5 and further comprising means for automatically inserting said stripper pins into said material layer in response to a programmed pattern defining said array.

7. The apparatus as set forth in claim 6 including means for robotically inserting said pins.

8. The apparatus as set forth in claim 7 wherein the interior ends of said pins include retaining means for engaging said resilient material and holding said pins therein.

9. The apparatus as set forth in claim 1 including means for advancing the blank over said lower support means.

10. The apparatus as set forth in claim 9 wherein said stripper pins include at least one stripper pin disposed to engage the leading edge of the scrap portion.

11. The apparatus as set forth in claim 10 wherein said stripper pin support matrix comprises an upper cylindrical roller having said layer of resilient deformable material attached to the surface thereof, and said lower support means comprises a lower cylindrical roller having an outer layer of a resilient deformable material.

12. An apparatus for stripping the scrap portion from a die cut sheet comprising:

a pair of counterrotating rolls each having a circumferential portion covered with a layer of a resilient compressible material;

means for advancing the die cut sheet between said rolls;

stripper pin means embedded in the material layer of one of said rolls and extending radially outwardly therefrom for engaging and pressing the leading edge of the scrap portion into the material layer of the other of said rolls and displacing said edge out of the plane of said sheet;

a scrap carrier disposed under the advancing sheet adjacent the downstream surface of said other roll, said carrier including a stripping edge closely spaced from the surface of said other roll, parallel to the axis thereof and extending generally along said material layer;

said stripping edge adapted to capture thereunder the displaced scrap edge and hold the scrap portion against the material layer of said other roll for rotation therewith to complete the stripping of said scrap portion from the sheet.

13. The apparatus as set forth in claim 12 wherein said stripper pin means are embedded in selectively variable positions in the material layer.

14. The apparatus as set forth in claim 13 wherein said stripper pin means are insertable into and removable from said material layer.

15. The apparatus as set forth in claim 14 wherein said stripper pin means comprises a plurality of individual pins, each having one relatively sharp end to facilitate insertion and a relatively blunt opposite end for engaging the scrap portion of the sheet.

16. The apparatus as set forth in claim 15 including means for inserting said stripper pins into said material layer in a patterned array representative of the location of each leading edge of a scrap portion on the sheet.

17. The apparatus as set forth in claim 16 wherein said means for inserting comprises a programmable robot.

18. The apparatus as set forth in claim 17 including means for removing said stripper pins from said material layer.

19. The apparatus as set forth in claim 18 wherein said means for removing comprises a programmable robot.

20. The apparatus as set forth in claim 17 comprising a pair of stripper pin-carrying rolls including an active stripper roll disposed in an operative stripping position and an inactive stripper roll disposed in a preparatory position in operative relation to said programmable robot.

21. The apparatus as set forth in claim 20 wherein each of said pin-carrying rolls is rotatably mounted to the end of a rotatable carrying arm for movement between said operative and preparatory positions.

22. The apparatus as set forth in claim 21 including means for indexing the inactive pin-carrying roll about its axis of rotation and for indexing said robot axially along the surface of said inactive roll to establish said patterened array of stripper pins.

23. The apparatus as set forth in claim 16 wherein said scrap carrier comprises a generally flat horizontal upper surface defining said stripping edge, and wherein said stripping edge comprises a series of teeth selectively retractable from said edge to form open spaces between alternate teeth, said spaces positioned to allow passage of each of said stripper pins between alternate teeth as said pins rotate out of engagement with the scrap portion.

24. The apparatus as set forth in claim 23 including means for retracting selected ones of said teeth in response to operation of said means for inserting said stripper pins.

25. The apparatus as set forth in claim 23 including means responsive to rotation of said stripper pin carrying roll for retracting said teeth from and returning said teeth to said stripping edge.

26. The apparatus as set forth in claim 23 wherein said scrap carrier includes a semicylindrical lower surface disposed concentrically with and spaced from the surface of said other roll by a distance less than the thickness of the sheet.

27. The apparatus as set forth in claim 26 wherein the layer of resilient compressible material on said one roll comprises a rubber compound.

28. The apparatus as set forth in claim 26 wherein said layer of resilient compressible material on said one roll comprises a plurality of layers of materials of varying compressibility.

29. The apparatus as set forth in claim 28 wherein said layers of varying compressibility comprise radially inner and outer layers of a relatively harder material and an intermediate layer of a softer material.

30. An apparatus for stripping the scrap portion from a die cut blank comprising:

a pair of counterrotating rolls;

means for advancing the die cut blank between said rolls;

stripper pin means on the outer surface of one of said rolls for stripping the scrap portion from the blank;

a layer of resilient compressible material covering a circumferential portion of the other of said rolls;

said stripper pin means extending radially outwardly from the outer surface of said one roll and positioned to engage and press the leading edge of the scrap portion into the material layer of said other roll and to displace said edge out of the plane of the blank;

a scrap carrier disposed under the advancing blank downstream of said other roll and adjacent to the surface thereof, said carrier including stripping edge means closely spaced from the surface of said other roll, parallel to the axis thereof and extending generally along said material layer for capturing the displaced scrap edge thereunder and holding the scrap portion against said material layer for rotation therewith to complete the stripping of the scrap portion from the blank.

31. The apparatus as set forth in claim 30 wherein said stripper pin means comprises a plurality of individual stripper pins.

32. The apparatus as set forth in claim 31 wherein said scrap carrier includes a generally flat supporting surface for the blank, said surface defining said stripping edge means, and wherein said stripping edge means comprises a toothed stripping edge having a series of laterally spaced teeth with the spaces between the teeth positioned to allow passage of each of said stripper pins through one of said spaces as said pins rotate out of engagement with the scrap portion.

33. The apparatus as set forth in claim 32 wherein said stripping edge comprises a series of laterally adjacent teeth each selectively retractable from said edge to define one of said spaces.

34. The apparatus as set forth in claim 33 wherein said scrap carrier includes a cylindrical lower surface disposed concentrically with and spaced from the surface of said other roll.

35. The apparatus as set forth in claim 34 wherein the space between said lower surface and the surface of said other roll is less than the thickness of the blank.

* * * * *